US007144078B2

(12) United States Patent
Hsieh

(10) Patent No.: US 7,144,078 B2
(45) Date of Patent: Dec. 5, 2006

(54) FOLDABLE FURNITURE DEVICE

(75) Inventor: Duan-Cheng Hsieh, Taipei (TW)

(73) Assignee: Habitex Corporation, Taipei (TW)

( * ) Notice: Subject to any disclaimer, the term of this patent is extended or adjusted under 35 U.S.C. 154(b) by 0 days.

(21) Appl. No.: 11/123,069

(22) Filed: May 6, 2005

(65) Prior Publication Data

US 2006/0249991 A1 Nov. 9, 2006

(51) Int. Cl.
*A47C 4/00* (2006.01)

(52) U.S. Cl. ..... 297/16.1; 297/16.2

(58) Field of Classification Search ..... 297/16.1, 297/16.2, 46, 56; 108/117, 118, 119, 120; 292/DIG. 37; 403/109.2, 109.3; 248/125.8, 248/404, 407, 408, 423
See application file for complete search history.

(56) References Cited

U.S. PATENT DOCUMENTS 5,485,655 A * 1/1996 Wang ..... 16/371
5,779,386 A * 7/1998 Eichhorn ..... 403/329
5,848,822 A * 12/1998 Wu ..... 297/344.18
6,062,589 A * 5/2000 Cheng ..... 280/647
6,158,067 A * 12/2000 Cheng ..... 5/106
6,170,907 B1 * 1/2001 Tsai ..... 297/16.1
6,263,895 B1 * 7/2001 Bang ..... 135/138
6,332,646 B1 * 12/2001 Tseng ..... 297/16.1
6,824,207 B1 * 11/2004 Lin ..... 297/16.1
6,840,573 B1 * 1/2005 Yao ..... 297/16.1
6,848,740 B1 * 2/2005 Reese ..... 297/16.1
6,854,916 B1 * 2/2005 Hsieh ..... 403/109.3

* cited by examiner

*Primary Examiner*—Peter M. Cuomo
*Assistant Examiner*—Sarah B. McPartlin
(74) *Attorney, Agent, or Firm*—Berenato, White & Stavish

(57) ABSTRACT

A foldable furniture device includes a looped frame, two first leg sections, and two second leg sections connected pivotally and respectively to the first leg sections so as to move between folded and unfolded states. Two sleeve units are sleeved slidably and respectively on the first leg sections, and each includes a positioning hole. Each sleeve unit slides toward and away from top ends of the first leg sections in the unfolded and folded states, respectively. Two locking units are inserted respectively into the first leg sections, and each includes a resilient positioning member that extends through a through hole in the corresponding first leg section to engage the positioning hole when the first and second leg sections are pivoted to the unfolded state so as to lock each sleeve unit against sliding movement.

5 Claims, 4 Drawing Sheets

FOLDABLE FURNITURE DEVICE

BACKGROUND OF THE INVENTION

1. Field of the Invention

The invention relates to a furniture device, more particularly to a foldable furniture device, such as a foldable chair.

2. Description of the Related Art

A foldable furniture device, as disclosed in pending U.S. application Ser. No. 10/995,423, includes a main frame, first and second leg frames, two slide rods, two securing units, and two locking units. The main frame is formed as a ring-shaped frame. The first leg frame includes two spaced-apart first leg sections which have top ends connected pivotally to the main frame. The second leg frame includes two spaced-apart second leg sections connected pivotally and respectively to the first leg sections so as to move between a folded state and an unfolded state. Each of the second leg sections includes an elongate slot having first and second ends respectively proximate to and distal from a top end of a respective second leg section. Each of the slide rods is inserted into and movable within the respective second leg section. Each of the securing units has a fastening element extending through the slot and the corresponding slide rod and fixed to the main frame, and is operable to slide the fastening element to the first and second ends of the slot in the unfolded and folded states of the furniture device, respectively. Each of the locking units is provided to lock the respective rod against movement when the fastening element moves to the first end of the slot.

Although the aforesaid foldable furniture device can achieve its intended purpose, there is a need to provide a foldable furniture device with a more simple and reliable structure.

SUMMARY OF THE INVENTION

Therefore, the object of the present invention is to provide a foldable furniture device with amore simple and reliable structure.

According to this invention, a foldable furniture device comprises a looped frame, a first leg frame, a second leg frame, two sleeve units, and two locking units. The first leg frame includes two spaced-apart first leg sections having top ends pivotally connected to the looped frame and through holes formed respectively proximate to the top ends of the first leg sections. The second leg frame includes two spaced-apart second leg sections connected pivotally and respectively to the first leg sections so as to move between a folded state and an unfolded state. Each of the second leg sections has a top end pivotally connected to the looped frame. The sleeve units are sleeved slidably and respectively on the first leg sections, and are connected pivotally to the looped frame. Each of the sleeve units includes a positioning hole. The locking units are provided for locking respectively the sleeve units against sliding movement, and are inserted respectively into the first leg sections. Each of the locking units includes a resilient positioning member that extends through one of the through holes to engage the positioning hole when the first and second leg sections are pivoted to the unfolded state. The sleeve units respectively slide toward the top ends of the first leg sections in the unfolded state, and away from the top ends of the first leg sections in the folded state.

BRIEF DESCRIPTION OF THE DRAWINGS

Other features and advantages of the present invention will be come apparent in the following detailed description of the preferred embodiment with reference to the accompanying drawings, of which.

DETAILED DESCRIPTION OF THE PREFERRED EMBODIMENT

Figure 1:
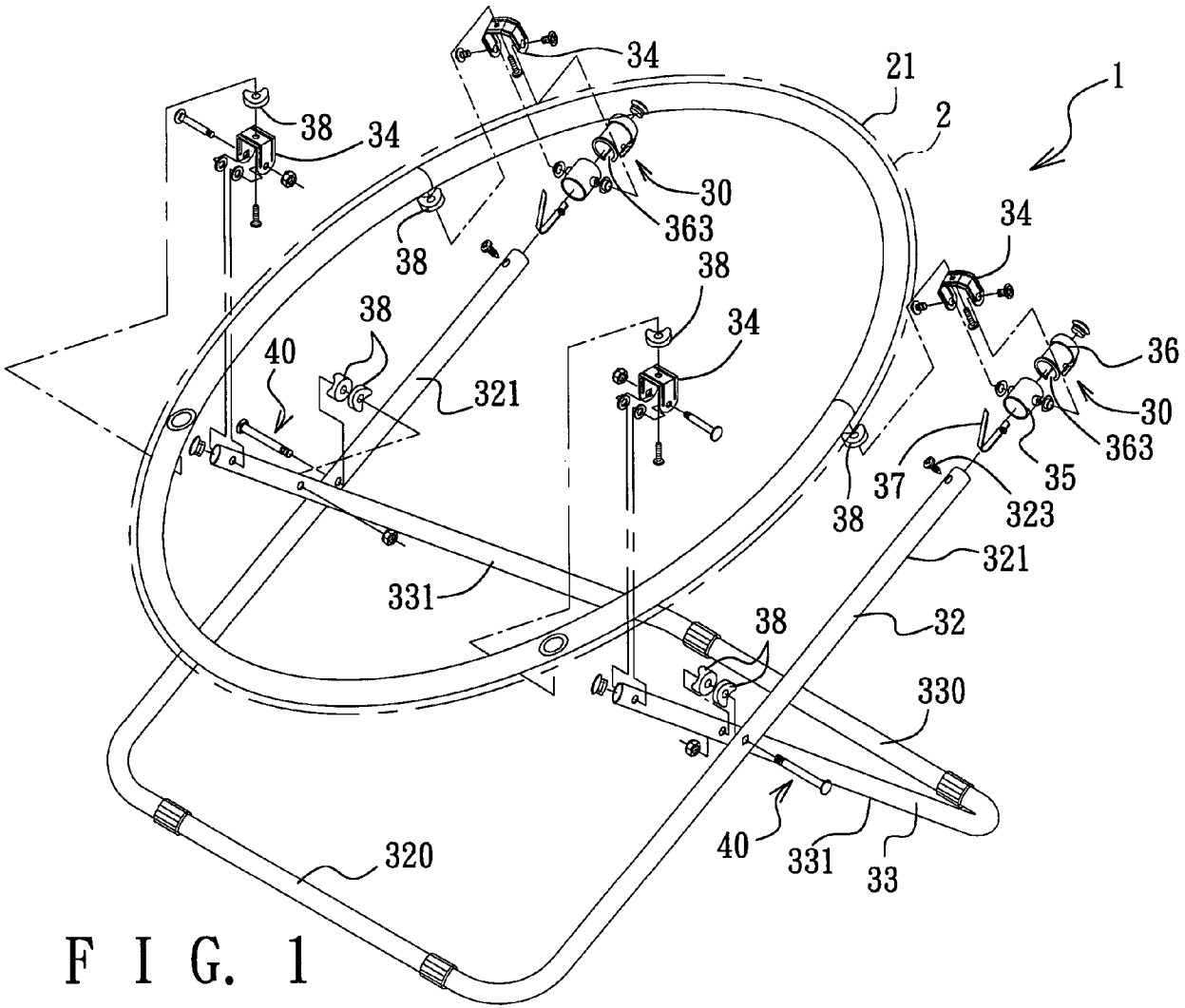
FIG. 1 is an exploded perspective view of the preferred embodiment of a foldable furniture device according to the present invention.
Figure 2:
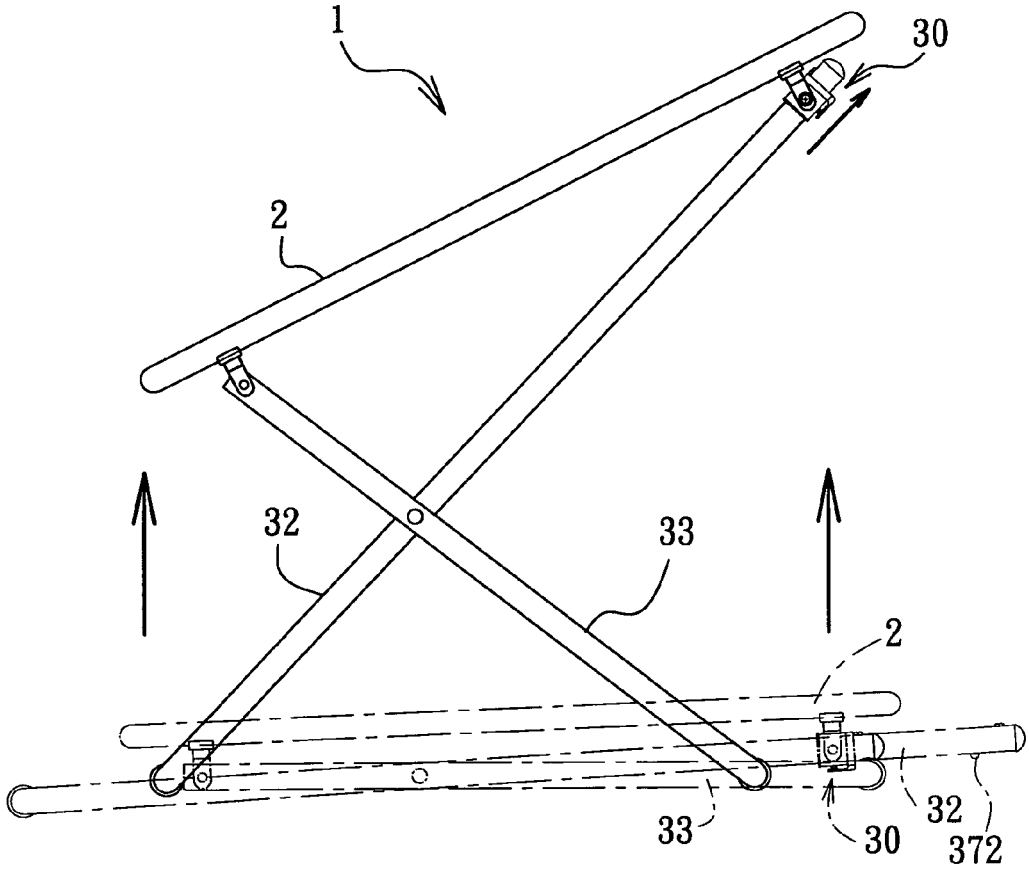
FIG. 2 is a schematic side view of the preferred embodiment.
Figure 3:
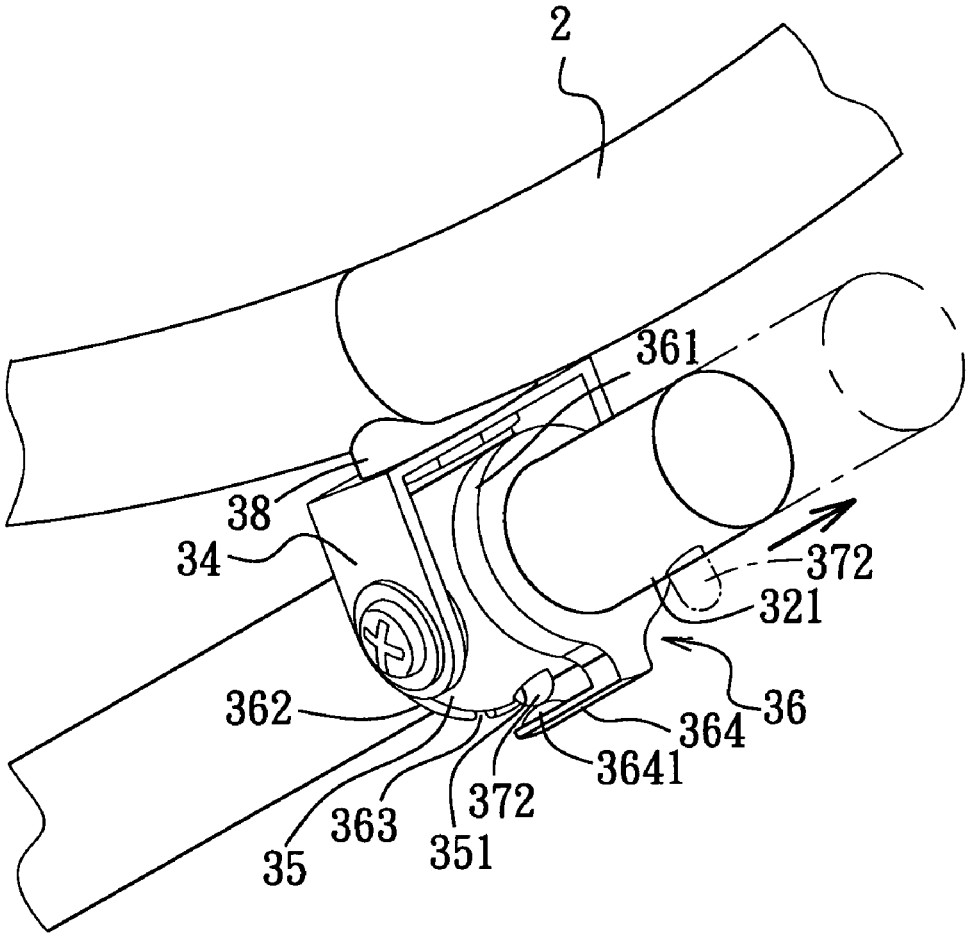
FIG. 3 is a fragmentary perspective view of the preferred embodiment, illustrating a resilient positioning member of a locking unit protruding out of an outer sleeve of a sleeve unit so as to restrict relative movement between a first leg section and a sleeve unit.
Figure 4:
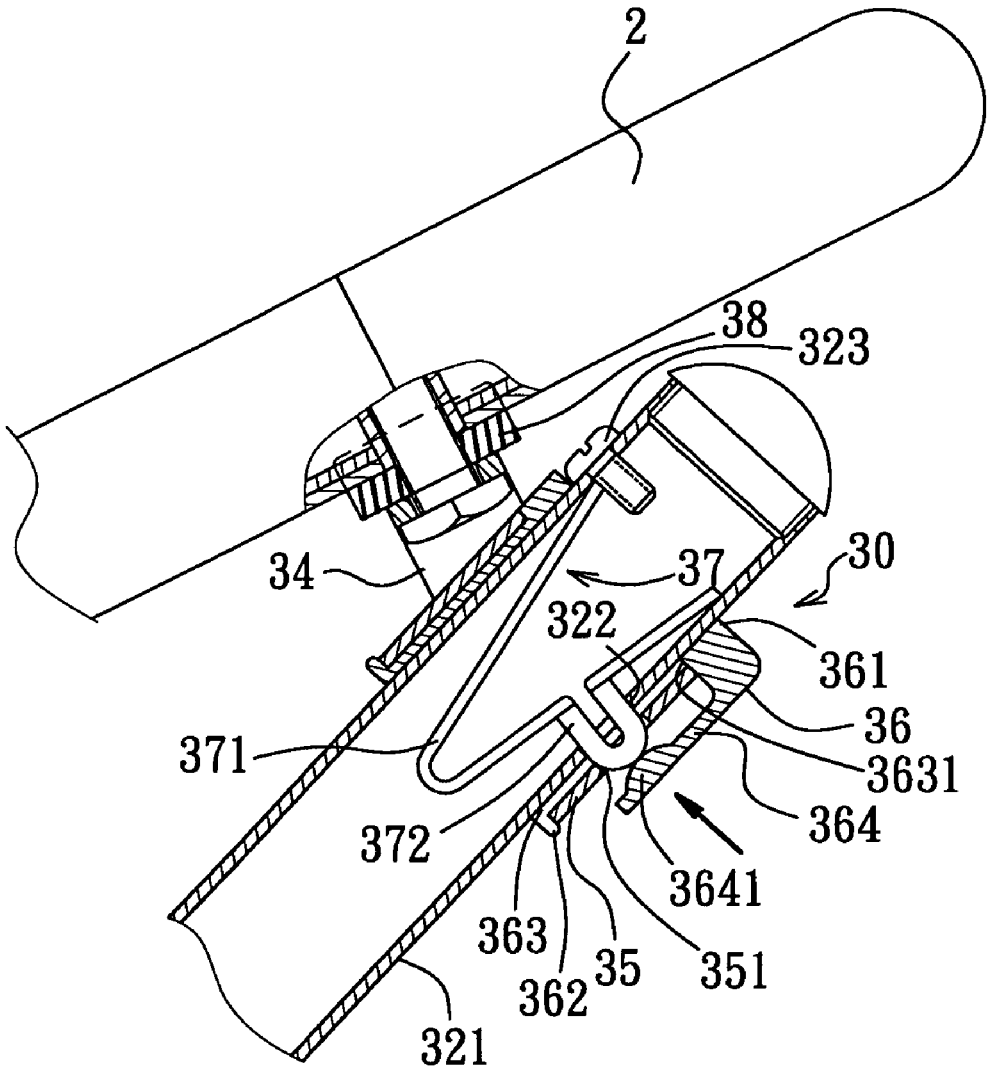
FIG. 4 is a fragmentary partly sectional view of the preferred embodiment, illustrating how the locking unit is positioned in the first leg section.

Referring to FIGS. 1 to 4, the preferred embodiment of a foldable furniture device according to the present invention is shown at "1" which designates a foldable chair. The foldable chair 1 comprises a looped frame 2, a first leg frame 32, and a second leg frame 33. The looped frame 2 includes a pliable bag 21 that envelopes the looped frame 2 to provide a seat for a user, four angularly spaced-apart inverted U-shaped pivot members 34 provided around and screwed to a bottom periphery of the looped frame 2, and four pads 38. Each of the pads 38 has a curved configuration that fits over the bottom periphery of the looped frame 2, and is disposed between the looped frame 2 and the respective pivot member 34 so as to prevent friction between the same.

The first leg frame 32 is made of metal, and includes two spaced-apart first leg sections 321 having top and bottom ends, and a cross bar 320 interconnecting the bottom ends of the first leg sections 321 so as to form a U-shaped configuration. A through hole 322 (see FIG. 4) is formed proximate to the top end of a respective one of the first leg sections 321.

The first leg frame 32 further includes two sleeve units 30 and two locking units 37. The sleeve units 30 are sleeved slidably and respectively on the first leg sections 321. Each of the sleeve units 30 includes an inner sleeve 36, and an outer sleeve 35 screwed pivotally to a corresponding one of the pivot members 34 of the looped frame 2. The inner sleeve 36 has top and bottom flanges 361, 362 (see FIG. 4), and is inserted between the outer sleeve 35 and a corresponding one of the first leg sections 321. The inner sleeve 36 is made of Teflon so as to facilitate sliding along the corresponding leg section 321. Alternatively, the inner sleeve 36 may be made of plastic. The outer sleeve 35 is sleeved around the inner sleeve 36 between the top and bottom flanges 361, 362, and is formed with a positioning hole 351. The inner sleeve 36 includes a press portion 364 and a cutout portion 363. The press portion 364 projects outwardly and radially from the top flange 361 to extend beyond the outer sleeve 35, and then turns axially and downwardly to confront the positioning hole 351. The cutout portion 363 extends upwardly from the bottom flange 362, and has a top end 3631 located below the top flange 361. The cutout portion 363 is aligned with the press portion 364 and the positioning hole 351. The press portion 364 further has a protrusion 3641 formed on a bottom end thereof facing the cutout portion 363.

A retaining screw 323 is attached to the top end of each of the first leg sections 321 so as to prevent the sleeve units 30 from sliding off the respective first leg sections 321.

The locking units 37 are provided for locking respectively the sleeve units 30 against sliding movement. Each of the locking units 37 has a substantially V-shaped bent spring plate. In particular, each of the locking units 37 includes two resilient arms 371, which are interconnected at one end to form a substantially V-shape, and a resilient positioning member 372 formed on one of the resilient arms 371 by a punching process. The resilient positioning member 372, which is in the form of a stud, extends through the through hole 322 in the corresponding first leg section 321. The other one of the resilient arms 371 is fixed to the respective first leg section 321 through the retaining screw 323.

The second leg frame 33 is made of metal, and includes two spaced-apart second leg sections 331 having top and bottom ends, and a cross bar 330 interconnecting the bottom ends of the second leg sections 331 so as to form a U-shaped configuration. The top ends of the second leg sections 331 are screwed pivotally and correspondingly to two of the pivot members 34 of the looped frame 2. The second leg sections 331 are further connected pivotally and respectively to the first leg sections 321 through pivot members 40 so as to move between a folded state and an unfolded state. Two pads 38, the construction of which has been described previously, are disposed at each connecting point between the first leg section 321 and the corresponding second leg section 331.

When the foldable chair 1 is unfolded, the first and second leg frames 32, 33 intersect each other, and support the looped frame 2 on the ground in an inclined manner. During the unfolding process, the sleeve units 30 slide toward the top ends of the first leg sections 321 until the resilient positioning member 372 of each locking unit 37 protrudes out of the outer sleeve 35 through the cutout portion 363 and the positioning hole 351 of the corresponding sleeve unit 30, thereby restricting relative movement between the first leg sections 321 and the sleeve units 30. The top flanges 361 of each inner sleeve 36 abut against the retaining screws 323 at this time.

When folding of the foldable chair 1 is desired, the press portions 364 are pressed inwardly and simultaneously so that the protrusions 3641 of the inner sleeves 36 push the resilient positioning members 372 of the locking units 37 away from the positioning holes 351 in the outer sleeves 35, thereby releasing engagement between the resilient positioning members 372 and the corresponding positioning holes 351. This permits the sleeve units 30 to slide away from the top ends of the respective first leg sections 321, and the first and second leg sections 321, 331 to pivot toward each other. After the first and second leg sections 321, 331 are folded, they are positioned below the looped frame 2.

From the aforementioned description, the present invention is provided with the sleeve units 30, each configured with the outer sleeve 35 connected pivotally to the looped frame 2, and the inner sleeve 36 inserted into the outer sleeve 35 for insertion of the respective first leg section 321 therethrough, so that the first leg sections 321 are not easily damaged and deformed due to an external force or frequent use, thereby prolonging the service life of the foldable chair 1. Further, due to the presence of the press portions 364 on the inner sleeves 36 of the sleeve units 30, the user can simply press the press portions 364 to release engagement between the resilient positioning members 372 of the locking units 37 and the corresponding positioning holes 351 in the outer sleeves 35 of the sleeve units 30, so that not only is the folding operation of the foldable chair 1 easy, but the user's fingers are not likely to be pinched during the folding operation.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A foldable furniture device comprising:

a looped frame;

a first leg frame including two spaced-apart first leg sections having top ends pivotally connected to said looped frame and through holes formed respectively proximate to said top ends of said first leg sections;

a second leg frame including two spaced-apart second leg sections connected pivotally and respectively to said first leg sections so as to move between a folded state and an unfolded state, each of said second leg sections having a top end pivotally connected to said looped frame;

two sleeve units sleeved slidably and respectively on said first leg sections and connected pivotally to said looped frame, each of said sleeve units including a positioning hole; and two locking units for locking respectively said sleeve units against sliding movement, said locking units being inserted respectively into said first leg sections, and each including a resilient positioning member that extends through one of said through holes to engage said positioning hole when said first and second leg sections are pivoted to said unfolded state;

said sleeve units respectively sliding toward said top ends of said first leg sections in said unfolded state, and away from said top ends of said first leg sections in said folded state; and wherein each of said sleeve units includes an outer sleeve connected pivotally to said looped frame, and an inner sleeve inserted between said outer sleeve and a corresponding one of said first leg sections, said inner sleeve having top and bottom flanges, said outer sleeve being sleeved around said inner sleeve between said top and bottom flanges.

2. The foldable furniture device as claimed in claim 1, wherein said positioning hole is formed in said outer sleeve, said inner sleeve including a press portion that projects outwardly and radially from said top flange to extend beyond said outer sleeve, and then turns axially and downwardly to confront said positioning hole.

3. The foldable furniture device as claimed in claim 2, wherein said inner sleeve further includes a cutout portion that extends upwardly from said bottom flange and that has a top end located below said top flange, said cutout portion being aligned with said press portion and said positioning hole.

4. The foldable furniture device as claimed in claim 1, wherein said each of said locking units has a substantially V-shaped bent spring plate, and includes two resilient arms, said positioning member being provided on one of said resilient arms.

5. The foldable furniture device as claimed in claim 1, wherein each of said first and second leg frames is substantially U-shaped.

* * * * *